US009273676B2

(12) United States Patent
Kuznetsov

(10) Patent No.: US 9,273,676 B2
(45) Date of Patent: Mar. 1, 2016

(54) PIEZOELECTRIC PUMP

(75) Inventor: Andrey Leionidovich Kuznetsov, Moscow (RU)

(73) Assignee: RENK LIMITED LIABILITY COMPANY, Moscow (RU)

( * ) Notice: Subject to any disclaimer, the term of this patent is extended or adjusted under 35 U.S.C. 154(b) by 278 days.

(21) Appl. No.: 13/807,013

(22) PCT Filed: Jul. 11, 2011

(86) PCT No.: PCT/RU2011/000504

§ 371 (c)(1),
(2), (4) Date: Jul. 1, 2013

(87) PCT Pub. No.: WO2012/008881

PCT Pub. Date: Jan. 19, 2012

(65) Prior Publication Data

US 2013/0287607 A1 Oct. 31, 2013

(30) Foreign Application Priority Data

Jul. 15, 2010 (RU) ..... 2010129235

(51) Int. Cl.
*F04B 17/03* (2006.01)
*F04B 17/00* (2006.01)

(52) U.S. Cl.
CPC ..... *F04B 17/003* (2013.01)

(58) Field of Classification Search
CPC ..... F04B 17/003; F04B 43/009; F04B 43/04; F04B 43/043; F04B 43/046; F04B 43/0009
See application file for complete search history.

(56) References Cited

U.S. PATENT DOCUMENTS 3,171,989 A 3/1965 Hatschek
3,598,506 A * 8/1971 O'Neill ..... 417/383

(Continued)

FOREIGN PATENT DOCUMENTS

CN 101216027 A 7/2008
EA 011817 B1 6/2009

(Continued)

OTHER PUBLICATIONS

Mark Vaughan, Donald J. Leo, "Integrated Piezoelectric Linear Motor for Vehicle Applications", 2002 ASME International Adaptive Structures and Materials Systems Symposium, Nov. 17-22, 2002, New Orleans, LA, USA.*

(Continued)

*Primary Examiner* — Nathan J Newhouse
*Assistant Examiner* — Philip Stimpert

(57) ABSTRACT

The piezoelectric pump comprises a housing, containing the following components connected in series: a rear piezoelectric clamp section, a piezoelectric extender section and a front piezoelectric clamp section. A displacer of pumped fluid is connected to the front piezoelectric clamp section. Electric pulses accessing at sections from a control station cause said sections to become fixed alternately inside the housing. Under the effect of electric pulses, the piezoelectric extender section moves the displacer step-by-step in one direction. Positive effect achieved by the invention is that of increasing the service life of the piezoelectric pump, expanding the scope of use thereof by increasing the number of fluids that can be pumped and also providing for a greater pressure by preventing contact between the pumped fluid and the friction surfaces of the housing and the piezoelectric clamp sections.

11 Claims, 2 Drawing Sheets

(56) References Cited

U.S. PATENT DOCUMENTS

| | | | |
|---|---|---|---|
| 4,735,185 | A | 4/1988 | Imoto et al. |
| 6,886,331 | B2 | 5/2005 | Joshi |
| 8,004,158 | B2 | 8/2011 | Hielscher |
| 2006/0126884 | A1 | 6/2006 | Hielscher |
| 2009/0311116 | A1 | 12/2009 | Bai et al. |
| 2014/0037471 | A1 | 2/2014 | Kuznetsov |

FOREIGN PATENT DOCUMENTS

| | | | |
|---|---|---|---|
| EP | 2065062 | A1 | 6/2009 |
| SU | 1689657 | A1 | 11/1991 |
| WO | 2014027931 | A1 | 2/2014 |

OTHER PUBLICATIONS

Shaun P. Salisbury, David F. Waechter, Ridha Ben Mrad, S. Eswar Prasad, Richard G. Blacow, Bin Yan, "Design considerations for complementary inchworm® actuators", Mechatronics, IEEE/ASME Transactions on (vol. 11 , Issue: 3 ), Jun. 19, 2006, pp. 265-272, IEEE.

David F. Waechter, Shaun Salisbury, Ridha Ben Mrad, S. Eswar Prasad, Richard G. Blacow, Bin Yan, "Complementary inchworm® actuator for high-force high-precision applications", Smart Structures and Materials 2004: Smart Structures and Integrated Systems, 13, Jul. 26, 2004.

A. Suleman, S. Burns, D. Waechter, "Design and Modeling of an Electrostrictive Inchworm Actuator", Mechatronics, IEEE/ASME Transactions on (vol. 14 , Issue: 5 ), Jun. 2004, pp. 567-586.

Mark Vaughan, Donald J. Leo, "Integrated Piezoelectric Linear Motor for Vehicle Applications", 2002 ASME International Adaptive Structures and Materials Systems Symposium, Nov. 17-22, 2002, New Orleans , LA, USA.

Jian Lia, Ramin Sedaghatia, Javad Dargahia, David Waechterb, "Design and development of a new piezoelectric linear Inchworm® actuator", Mechatronics, IEEE/ASME Transactions on (vol. 15 , Issue: 6 ), Jul. 2005, pp. 651-681, IEEE.

* cited by examiner

PIEZOELECTRIC PUMP

FIELD OF THE INVENTION

The invention relates to a device for pumping fluids, and may be used in industry, transport and households when pumping liquids, and other incompressible and compressible fluids.

BACKGROUND OF THE INVENTION

The closest analogue of the claimed technical solution is a piezoelectric pump to displace fluid, the pump is part of the dispenser described in the U.S. Pat. No. 7,682,354, 23 Mar. 2010, U.S. Class 604/890.1. The pump includes a housing, a rear piezoelectric clamp section, a piezoelectric extender section, a front piezoelectric clamp section, the sections are contained in the housing and connected in series. The clamp sections are mace of piezoelectric material that can press on the walls of the housing from inside at accession of an electric potential to them. The piezoelectric extender section is made of a material capable to change its length at accessing of an electric potential to it.

The main drawback of the analogue is that the displaced fluid contacts friction surfaces of the housing and the clamp sections, because the front clamp section acts as the fluid displacer in this design. It cause low clamping force and as a consequence cause low pump pressure. Also it may cause corrosion, wear and quick pump failure when chemically aggressive fluid, or fluid with smallest hard particles contact friction surfaces of piezoelectric housing and clamp sections. Existence of gaps between the ends of clamp sections and the housing in the phase where an electric potential is not accessing to them may be considered as disadvantage. This cause vibration during operation, low reliability and low efficiency.

SUMMARY OF THE INVENTION

The technical problem to be solved by the present technical solution is to create a reliable, versatile and effective piezoelectric pump.

Positive effect achieved by the invention is an increase of the piezoelectric pump service life, expanding scope of use thereof by increasing the number of fluids that can be pumped and also providing for a greater pressure by preventing contact between the pumped fluid and the friction surfaces of the housing and the piezoelectric clamp sections.

For solution of the technical problem with achievement of a positive effect, in a piezoelectric pump, comprising a housing, a rear piezoelectric clamp section, a piezoelectric extender section, a front piezoelectric clamp section, contained in the housing and connected in series, according to the claimed invention additionally introduced a displacer of pumped fluid, connected to the front piezoelectric clamp section.

Introducing a displacer of pumped fluid into the design, connected with the front piezoelectric damp section, it becomes possible to create a reliable, versatile, and effective piezoelectric pump.

Liquid or another displaced fluid in the claimed design does not fill space of the housing in front of the front piezoelectric clamp section, but is isolated in the displacer. This prevents corrosion and possible wear of the contacting friction surfaces of the housing and the damp piezoelectric sections. Consequently, the pump can deliver fluids of a wide range, aggressive, lubricating, with solid particles (fibers, sand). Increased pressure of the piezoelectric pump, that is essential to its efficiency, is provided by reliable friction between the piezoelectric damp sections and the housing in the contact areas, that can be achieved at absence of the pumped fluid between these parts.

DESCRIPTION OF THE DRAWINGS

The abovementioned advantages of the invention and its features are explained in the preferred embodiment with reference to the drawings.

DESCRIPTION OF A PREFERRED EMBODIMENT

Figure 1:
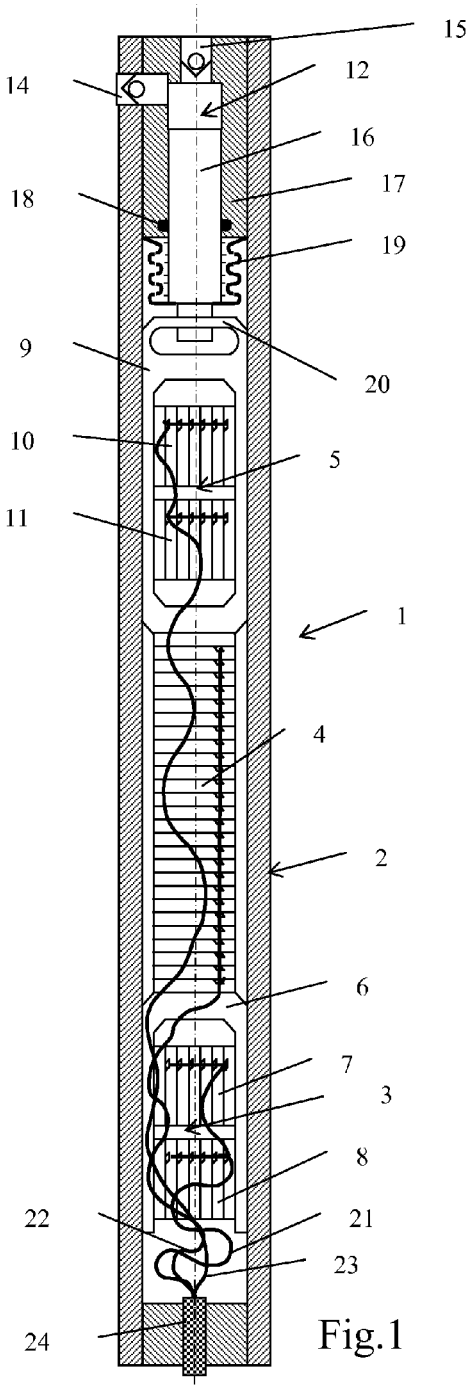
FIG. 1 is a piezoelectric pump, a plunger is a displacer of pumped fluid.

The piezoelectric pump 1 (FIG. 1 and 4) comprises a housing 2, a rear piezoelectric clamp section 3, a piezoelectric extender section 4, a front piezoelectric damp section 5. The rear piezoelectric damp section 3 consists of a bracket 6, piezostacks 7 and 8. The front piezoelectric clamp section 5 consists of a box 9 and piezostacks 10 and 11. Depending on required pressure the required number of the piezostacks in the pump clamp sections is included. There is a displacer 12 of the pumped fluid in the front part of the pump. To provide cycling operation there are inlet valves 13, 14 and an exhaust valve 15.

For the pump shown in FIG. 1, as a displacer of fluid a plunger pair 12 is selected consisting of a plunger 16 and a plunger housing 17. A seal 18 is used to prevent leakage. A bellows 19 is added to the design shown in FIG. 1, completely isolating fluid pumped by the plunger pair from the housing 1, where the piezoelectric sections 3, 4 and 5 move. The plunger 16 is connected to the box 9 with a leaf spring 20, the leaf spring 20 is the part of the box 9. The leaf spring 20 reduces vibrating oscillations transmitted to the plunger 16 that are generated by the front clamp section 5 during its forward movement.

An electrical wire 21 is connected to the piezostacks 7 and 8 of the rear piezoelectric clamp section 3. An electrical wire 22 is connected to the piezoelectric extender section 4. An electrical wire 23 is connected to the piezostacks 10 and 11 of the front piezoelectric clamp section 5. The electrical wires 21, 22 and 23 are also connected to the electrical socket 24.

Figure 2:
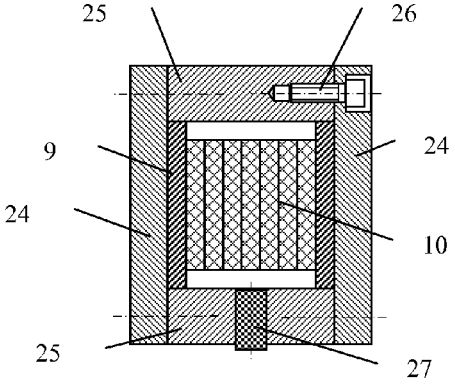
FIG. 2 is a cut view of the piezoelectric pump at tie piezoelectric damp section (wires not shown)

The housing 2 comprises two friction plates 24 and two lateral plates 25 (FIG. 2), held together by bolts 26. The piezostacks 7, 8, 10, 11 of the rear 3 and the front 5 clamp sections a out the friction plates 24 with their ends through bars of the bracket 6 (for the rear section 3) or of the box 9 (for the front sections 5). Size of the two lateral plates 25 between faces contacting with the friction plates 24 is made with very high accuracy. In FIG. 2 the piezostack 10 of the front piezoelectric damp section 5 is shown in the cut view. Also a feed-back sensor 27 to control a position of the front piezoelectric clamp section 5 is shown. There is a compressing rod 28 (FIG. 3 and 5) inside the piezoelectric extender section 4. There are notches 29 (FIG. 6) in compressing rod 28 to reduce its stiffness in longitudinal direction.

Figure 4:
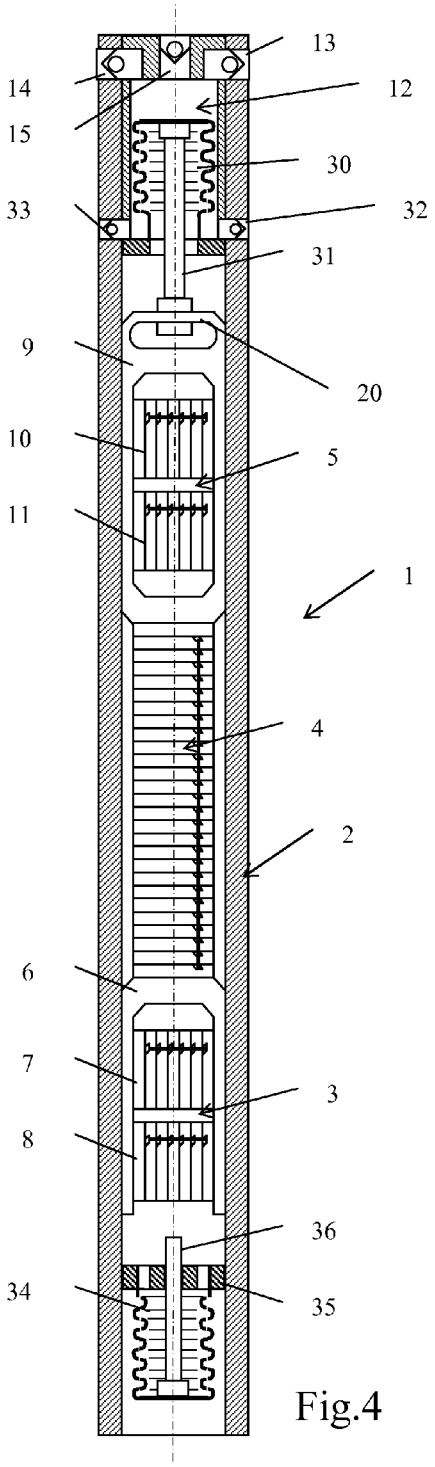
FIG. 4 is a piezoelectric pump with bellows as a fluid displacer (wires not shown)

The bellows as a displacer of the pumped fluid for the pump is shown in FIG. 4. Tensile and compressive force is transferred to the active bellows 30 from the box 9 through the leaf spring 20 and the rod 31. To eliminate dead spaces at pumping fluids containing sand particles, there are additional intake valves 32 and 33 near the fixed part of the active bellows 30 in the housing.

One of the possible applications of the claimed pump design is pumping of fluids at widely varying ambient fluid pressure. To provide this the internal space of the housing 2, that contains the rear piezoelectric clamp section 3, the piezoelectric extender section 4 and the front piezoelectric clamp section 5 is filled with liquid. The pump 1 contains a passive bellows 34, attached to a wall 35 in this case. To exclude grazing of it to the housing 2 a rear rod 36 is provided. The rod is connected to a bottom of the bellows and is able to slip longitudinally in one of holes in the wall 35.

Figure 7:
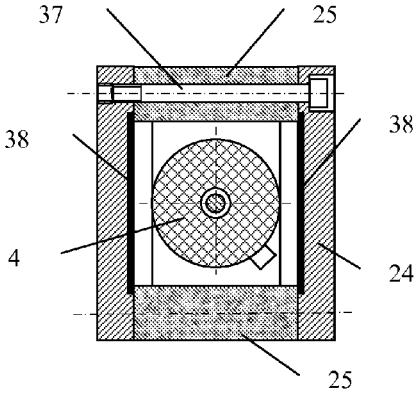
FIG. 7 is a cut view of the piezoelectric pump at the piezoelectric extender section (wires not shown). The housing is mace of high modulus ceramics.

Because rigidity of lateral plates 25 is crucial for effective operation of the piezoelectric pump 1, ceramics or stone with a high modulus of elasticity of the 1st kind as the material of the lateral plates may be used in case of restrictions in weight or dimensions. That requires contracting of the housing 2 parts with long bolts 37 (FIG. 7). Also it is important to provide high friction coefficient for efficiency of the pump between the bracket 6, the box 9, on the one hand, and the friction plates 24 of the housing 2, on the other hand. To increase this coefficient a coating 38 is applied on the friction plates 24 (FIG. 7). Also the coating can be applied on the sliding surfaces of the bracket 6 and box 9.

The device operates as follows.

In the first phase of discharge the rear piezoelectric clamp section 3 (FIG. 1 and 4) is in the clamped state. That means pressing of the bracket 6 onto the housing 2 from inside in the transverse direction. This happens due to accession of an electric potential from the electric socket 24 (FIG. 1) through the wire 21 to the piezostacks 7 and 8. The front piezoelectric clamp section 5 (FIG. 1 and 4) in this phase of discharge is in a free state, clamping force is minimal or is absent between the box 9 and the plates of the housing 2. At the same time there is no gap. A gap indicates the incorrect settings, fault, excessive temperature or wear of the pump 1. Existence of the gap cause additional vibration, lowering of pressure and closest failure of the device.

Figure 3:
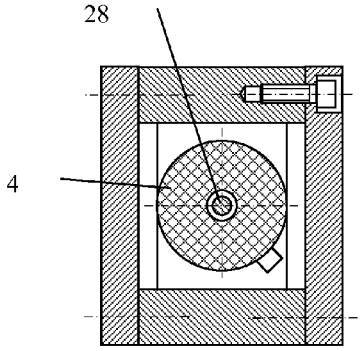
FIG. 3 is a cut view of the piezoelectric pump at the piezoelectric extender section (wires no shown)
Figure 5:
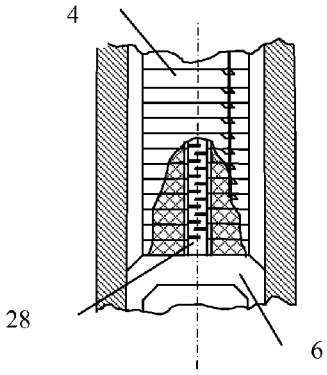
FIG. 5 is a cut on the extender section to view a compressing rod.
Figure 6:
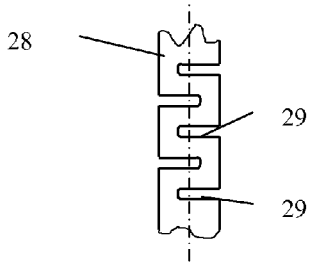
FIG. 6 is a close-up view of a compressing roc embodiment.

In the second phase of discharge an electric potential comes through the wire 22 (FIG. 1) to the piezoelectric extender section 4 (FIG. 1 and 4), and the section increases its length. The front clamp section 5 connected to it moves for a short distance against the force of the compression rod 28 (FIG. 3 and 5). Accordingly the front clamp section 5 (FIG. 1 and 4) moves the plunger 16 (FIG. 1) or the rod 31 (FIG. 4) with the active bellows 30 forwardly. Also moves the pumped fluid filling the space in front of the displacer 12 of the pumped fluid (FIG. 1 and 4), that fills space between the plunger 16 and the plunger housing 17 (FIG. 1) or between the housing 2 and the active bellows 30 (FIG. 4). The intake valves 13 (FIG. 1) and 14 (FIG. 1 and 4) are closed at this phase. Also the additional intake valves 32 and 33 (FIG. 4) are closed. The exhaust valve 15 (FIG. 1 and 4) in the second phase of discharge is opened. The pumped fluid goes out of the piezoelectric pump 1 at certain pressure through that valve.

In the third phase of discharge an electric potential from the wire 23 (FIG. 1) comes to the front piezoelectric clamp section 5 (FIG. 1 and 4), to its piezostacks 10 and 11, and the box 9 starts to press from inside to the housing 2. In other words, section 5 turns into a clamped state. At the same time an electric potential from the wire 21 does not come to the rear piezoelectric clamp section 3 (FIG. 1 and 4), and it turns into a free state, not clamping from inside on the housing 2, or clamping with the least possible pressure. However there is no gap between the housing and the box 9 also in this case.

In the fourth phase of discharge an electric potential does not come any more through the wire 22 (FIG. 1) to the piezoelectric extender section 4 (FIG. 1 and 4). The section 4 turns into the idle state, that is, its length is decreased. The rear piezoelectric clamp section 3 (FIG. 1 and 4) moves forwardly for a short distance from the force of the compression rod 28 (FIG. 3 and 5). At the end of the fourth discharge charge phase an electric potential does not access to the front piezoelectric clamp section 5 (FIG. 1 and 4) from the wire 23 (FIG. 1), and it turns to the idle state, that means it does not press from inside on the housing 2.

Such a phase sequence is repeated at discharge many times until the working body of the fluid displacer 12 (the plunger 16 in FIG. 1, or the active bellows 30 in FIG. 4) reaches its extreme front position. The moment when the extreme front position is reached is determined from a curve of the electric current changing in the wire 22 (FIG. 1). Also, this moment can be monitored by means of a feed-back sensor 27 (FIG. 2).

Sucking starts after the working body of the fluid displacer 12 (FIG. 1 and 4) reaches its extreme front position. In the first 31 phase of suction the rear piezoelectric damp section 3 of the piezoelectric pump 1 is in a free state, that is, the bracket 6 does not press on the housing 2 from inside, or it presses with minimal effort. This happens due to absence of an electric potential on the wire 21 (FIG. 1) and piezostacks 7 and 8 (FIG. 1 and 4). The front piezoelectric damp section 5 in this phase is in the damped state, effort is maximal between the box 9 and the walls of the housing 2.

In the second phase of the suction an electrical potential comes through the wire 22 (FIG. 1) to the piezoelectric extender section 4 (FIG. 1 and 4), and the section increases its length. In this case the rear damp section 3 is moved back at a short distance, against the force of the compression rod 28 (FIG. 3 and 5).

In the third phase of suction an electrical potential does not come from the wire 23 (FIG. 1) on the front piezoelectric damp section 5 (1 and 4), more exactly in its piezostacks 10 and 11, and the box 9 stops to press from inside on the housing 2. In other words, the section 5 turns to its idle state. At the same time an electric potential from the wire 21 (FIG. 1) comes to the rear piezoelectric damp section 3 (FIG. 1 and 4), and it turns into the damped state, starting to press on the housing 2 from inside.

In the fourth phase of the suction an electrical potential does not come through the wire 22 (FIG. 1) to the piezoelectric extender section 4 (FIG. 1 and 4). This section under force of the compressing rod 28 (FIG. 3 and 5) turns into the idle state, that is, reduces its length. The front piezoelectric damp section 5 (FIG. 1 and 4) moves back for a short distance in this case. Accordingly, it moves back the plunger 16 (FIG. 1) or the rod 31 (FIG. 4) with the active bellow 30. The intake valve 13 (FIG. 1) and 14 (FIG. 1 and 4) are opened, also the additional intake valves 32 and 33 (FIG. 4) are opened. Through the open valves the pumped fluid fills the space between the plunger 16 (FIG. 1) and the plunger housing 17, or between the active bellows 30 (FIG. 4) and the housing 2. Fluid coming into the space to the base of the active bellows 30 (FIG. 4) through the additional intake valves 32 and 33, blurs and moves the sand particles accumulated in this area up to the exhaust valve 15.

The exhaust valve 15 (FIG. 1 and 4) in the fourth phase of the suction are closed. At the end of the fourth phase of the suction an electrical potential from the wire 21 (FIG. 1) does not come to the rear piezoelectric damp section 3 (FIG. 1 and 4), and it turns to the idle state.

Oscillations of the plunger 16 (FIG. 1) or rod 31 (FIG. 4) with the active bellows 30 due to vibration of the front piezoelectric clamp section 5 (FIG. 1 and 4) are smoothed due to bending and straightening of the leaf spring 20, made on the box 9. That reduces possibility of fluid cavitation and longitudinal vibration of the pump 1.

When pumping fluids at high or variable ambient pressure fluid that fills the inner space of the housing 2 (FIG. 4), where the rear piezoelectric clamp section 3, piezoelectric extender section 4, front piezoelectric clamp section 5 move, is forced into a passive bellows 34. Due to incompressibility of fluid this bellows oscillates back and forth along with the rear rod 36 following oscillations of the active bellows 30 synchronously with it. The rear rod 36 slides in one of the holes of the wall 35, preventing bends of the bellows 34 to rub the housing 2.

USAGE IN THE INDUSTRY

The most successfully the claimed piezoelectric pump is industrially applicable in transport and industry for pumping fluids of high pressure and relatively low supply, where use of other types of pumps is hardly possible due to dimensions, weight and effectiveness.

The invention claimed is:

1. A piezoelectric pump, comprising:
a housing-having an imaginary longitudinal axis, the housing containing:
a rear piezoelectric clamp section including: a first frame and a first piezoelectric stack within the first frame, the first piezoelectric stack being configured, in response to being supplied with electrical voltage, to cause the first frame to press the housing from inside thereof in a direction transverse of the imaginary longitudinal axis,
a piezoelectric extender section that is movable relative to the housing along the imaginary longitudinal axis,
a front piezoelectric clamp section including a second frame and a second piezoelectric stack within the second frame, the second piezoelectric stack being configured, in response to being supplied with electrical voltage, to cause the second frame to press the housing from inside thereof in the direction transverse of the imaginary longitudinal axis, and
a fluid displacer of pumped fluid coupled to the front piezoelectric clamp section;
the rear piezoelectric clamp section, the piezoelectric extender section and the front piezoelectric clamp section being connected in series along the imaginary longitudinal axis,
wherein the housing comprises two friction plates and two lateral plates.

2. The piezoelectric pump according to claim 1, the fluid displacer comprising a plunger pair, the plunger pair including a plunger housing and a plunger contained therein.

3. The piezoelectric pump according to claim 2, wherein the plunger is coupled to the front piezoelectric clamp section by a leaf spring.

4. The piezoelectric pump according to claim 2, wherein the fluid displacer further comprises a bellows having a front rim and a rear rim, and wherein:
the front rim is coupled to the plunger housing,
a rear portion of the plunger is contained in the bellows,
the rear rim of the bellows is coupled to a front opening of the housing,
thereby completely isolating pumped fluid from the housing.

5. The piezoelectric pump according to claim 1, wherein the material of the two lateral plates is ceramics.

6. The piezoelectric pump according to claim 5, wherein both the first frame and the second frame abut the friction plates.

7. The piezoelectric pump according to claim 1, wherein the piezoelectric extender section comprises a compressing rod.

8. The piezoelectric pump according to claim 1, the housing further including an intake valve and an exhaust valve.

9. The piezoelectric pump according to claim 8, wherein the fluid displacer comprises an active bellows that includes a fixed portion and wherein the housing further comprises an additional intake valve located proximate the fixed portion.

10. The piezoelectric pump according to claim 1, wherein an internal space of the housing that houses the rear piezoelectric clamp section, the piezoelectric extender section and the front piezoelectric clamp section is configured to be filled with liquid.

11. A piezoelectric pump, comprising:
a housing-having an imaginary longitudinal axis, the housing containing:
a rear piezoelectric clamp section including: a first frame and a first piezoelectric stack within the first frame, the first piezoelectric stack being configured, in response to being supplied with electrical voltage, to cause the first frame to press the housing from inside thereof in a direction transverse of the imaginary longitudinal axis,
a piezoelectric extender section that is movable relative to the housing along the imaginary longitudinal axis,
a front piezoelectric clamp section including a second frame and a second piezoelectric stack within the second frame, the second piezoelectric stack being configured, in response to being supplied with electrical voltage, to cause the second frame to press the housing from inside thereof in the direction transverse of the imaginary longitudinal axis, and
a fluid displacer of pumped fluid coupled to the front piezoelectric clamp section;
the rear piezoelectric clamp section, the piezoelectric extender section and the front piezoelectric clamp section being connected in series along the imaginary longitudinal axis,
wherein the housing comprises two friction members and two lateral members.

* * * * *